United States Patent [19]

Kiviranna

[11] 4,090,123

[45] May 16, 1978

[54] REGULATED POWER SUPPLY CROW-BAR PROTECTION

[75] Inventor: John Kiviranna, Flushing, N.Y.

[73] Assignee: Forbro Design Corp., New York, N.Y.

[21] Appl. No.: 740,962

[22] Filed: Nov. 11, 1976

[51] Int. Cl.[2] ..... G05F 1/58

[52] U.S. Cl. ..... 323/8; 361/18

[58] Field of Search ..... 323/8, 9; 361/18, 91

[56] References Cited

U.S. PATENT DOCUMENTS

| | | | |
|---|---|---|---|
| 3,736,491 | 5/1973 | Kuster | 323/8 X |
| 3,796,919 | 3/1974 | Johnson | 323/8 X |
| 3,816,809 | 6/1974 | Kuster | 361/91 X |
| 3,819,986 | 6/1974 | Fukuoka | 323/8 X |

OTHER PUBLICATIONS

Summer, "SCR Crowbar Circuit Fires Quickly and Surely", Electronics, vol. 47, No. 3, Feb. 7, 1974, pp. 104, 323–328.

*Primary Examiner*—A. D. Pellinen

*Attorney, Agent, or Firm*—Alfred W. Barber

[57] ABSTRACT

When a regulated power supply incorporating a series pass transistor as the regulating element is crow-barred, the control circuitry continues to drive the pass transistor to maximum available current. The pass transistor may be overheated and eventually both the pass transistor and the crow-bar itself may be damaged. To prevent this latter from happening, the drive to the pass transistor is cut back in response to the actuation of the crow-bar.

6 Claims, 1 Drawing Figure

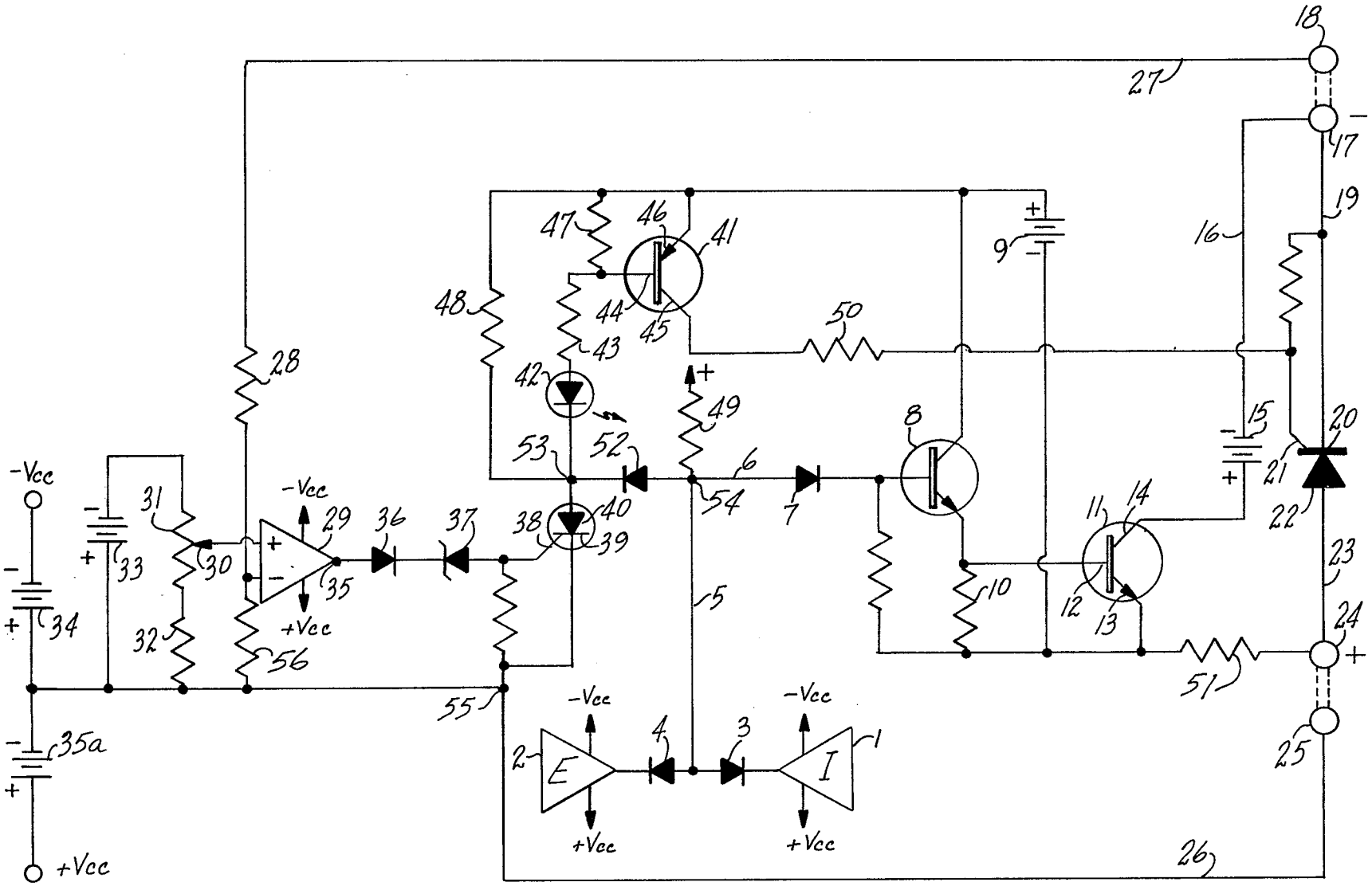
-Vcc
+Vcc
I
E

REGULATED POWER SUPPLY CROW-BAR PROTECTION

PRIOR ART

A well known regulator circuit for voltage regulated power supplies employs what is terned a "series pass" device. This may be any signal controllable resistance device such as a vacuum tube or power transistor. The present invention applies particularly to the type of regulated power supply employing a power transistor as the series pass device.

It is also well known to protect the load from over-voltage conditions by means of a signal responsive shunt called a crow-bar. The crow-bar is a silicon controlled rectifier or similar device capable of being turned on by a suitable signal to provide a short circuit across the load terminals of the power supply.

It is also common practice to provide both voltage regulation and current regulation in a regulated power supply and to provide for automatic cross-over from one mode to the other.

Typical examples of cross-over regulated power supplies are shown and described in U.S. Pat. Nos. 3,305.763 and 3,495,157. One example of a crow-bar circuit is shown and described in U.S. Pat. No. 3,594,612.

While the crow-bar has been used effectively to short the output of a regulated power supply in the presence of a potentially harmful over-voltage condition, it leads to some other problems. When the output is shorted, the voltage control circuitry calls for more voltage which under normal conditions would reestablish a predetermined output voltage. This call for more voltage drives the pass transistor into greater and greater conduction. This combination of shorted output and high conduction in the pass transistor often causes the pass transistor to become over-heated. It often causes the crow-bar silicon controlled rectifier to over-heat as well.

THE PRESENT INVENTION

In a typical voltage/current cross-over regulated power supply (see U.S. Pat. No. 3,495,157 referenced above) two control amplifiers are employed, one for voltage regulation and the other for current regulation. The outputs of these two amplifiers are OR-gated by means of two back-to-back diodes to the input of a driver transistor which, in turn, drives the series pass transistor. In accordance with the present invention this gate is clamped by a pilot silicon controlled rectifier which also turns on the crow-bar in response to a signal from a crow-bar detector circuit. The crow-bar detector compares the output voltage with a settable reference voltage and turns on the pilot SCR when the output voltage exceeds a predetermined (set) voltage. The pilot SCR turns on a crow-bar driver which, in turn, turns on the silicon controlled rectifier crow-bar. The pilot SCR turns on a crow-bar indicator lamp. The pilot SCR, as stated above, also clamps the gates of the voltage and current amplifiers robbing the pass transistor driver of input voltage causing the pass transistor to go out of conduction. With the pass transistor out of conduction it will not over heat and it will not supply current to the crow-bar causing it to over heat.

The FIGURE of the drawing is a simplified schematic circuit diagram of the essential components of the preferred form of the present invention.

In the FIG., current control amplifier 1 and voltage control amplifier 2 are coupled in a conventional manner to reference voltage sources and output current and voltage sensing means, not shown. The outputs of these amplifiers are connected through an OR-gate consisting of back-to-back connected diodes 3 and 4 over leads 5 and 6, through diode 7 to the base of driver transistor 8. The base 12 of series pass transistor 11 is coupled to the emitter of driver transistor 8 across emitter resistor 10. Emitter 13 of series pass transistor 11 is connected to load terminal 24 through current sensing resistor 51. The drop across resistor 51 is utilized in a conventional manner, details of which are not shown to provide current regulation through amplifier 1. Load terminal 24 is intended to be connected to the load while the remote error sensing terminal 25 shown connected to load terminal 24 provides one side of the feedback circuit over lead 26 to various control circuits. It is shown here going to the crow-bar detector amplifier 29. The collector 14 of series pass transistor 11 is connected through a suitable source of unregulated potential represented by battery 15 to load terminal 17. Load terminal 17 is intended to be connected to the load while terminal 18 may be used as a second remote error sensing terminal and is connected over lead 27 and through resistor 28 to the inverting input of crow-bar amplifier 29. Resistor 56 acts as a divider with resistor 28 to provide a voltage at the inverting input conveniently comparable with a reference voltage at potentiometer variable contact point 30.

The essence of the present invention is the crow-bar and fold-back circuit now to be described. The circuit includes crow-bar detector amplifier 29; pilot crow-bar silicon controlled rectifier 38–39–40; crow-bar driver transistor 41; and main crow-bar silicon controlled rectifier 20–21–22. Crow-bar detector amplifier 29 is provided with a reference voltage applied to its non-inverting input terminal by means of a source of dc voltage represented by a battery 33 divided by resistor 32 and potentiometer 31, the adjustable contact 30 being the point of reference voltage applied to the non-inverting input. The inverting input of detector amplifier 29 receives the remote sensed output voltage over line 27 and through resistor 28. Output terminal 35 of detector amplifier 29 is coupled through steering diode 36 and level shifting zener diode 37 to gate 38 of pilot silicon controlled rectifier 38–39–40. Cathode 39 is returned to common sense line 26. Anode 40 is coupled to base 44 of driver transistor 41 through light emitting diode 42 and resistor 43. Emitter 46 is connected to a source of positive potential represented by battery 9. Collector 45 is coupled through resistor 50 to gate 21 of main crow-bar silicon controlled rectifier 20–21–22. Anode 22 is directly connected over lead 23 to positive output terminal 24 and cathode 20 is directly connected over lead 19 to negative output terminal 17. Diode 52 is connected between junction point 53 between anode 40 and diode 42 and junction point 54 between lines 5, 6 and resistor 49.

In operation, when the voltage fed back from negative output sensing terminal 18 through resistor 28 and across divider resistor 56 exceeds the present voltage applied to the noninverting input, amplifier 29 switches from a negative going output to a positive going voltage on output terminal 35. This positive voltage applied to gate 38 through diodes 36 and 37 turns on silicon controlled rectifier 38–39–40. This latter action clamps the potential of point 53 to the common potential at point 55 and thereby drawing current through resistor 47, diode 42 and resistor 43 causing driver transistor 41 to conduct. The conduction of transistor 41 supplies current from collector 45 through resistor 50 to gate 21 causing silicon controlled rectifier 20–21–22 to go into conduction thereby crowbarring output terminals 17 and 24. The current passed through light emitting diode 42 which occurs as long as point 53 is held down to the reference potential of point 55 causes it to glow acting as a crow-bar condition indicator. Current supplied through resistor 48 connected between positive source 9 and junction point 53 serves to keep pilot crow-bar silicon controlled rectifier 38–39–40 in conduction until the system is reset as by turning the input power off and then on again.

As described so far, when a crow-bar operation takes place, the voltage control amplifier calls for more output voltage resulting in more current being called for through pass transistor 11. However, the output terminals are shorted by the crow-bar resulting in a large voltage drop in the pass trnasistor and at heavy current. Such a condition can quickly damage the pass transistor. To prevent this from happening, diode 52 is connected between junction points 53 and 54 with its cathode at junction point 53. Now, since silicon controlled rectifier 38–39–40 is in conduction, junction point 53 is at a low potential, and essentially that of common line 26. Diode 52 therefore conducts and effectively shorts junction point 54 to line 26 thereby removing forward drive through diode 7 to the base of driver transistor 8 and, in turn, removing drive from pass transistor 11. Thus, with its drive removed, pass transistor 11 becomes essentially non-conducting thereby passing little or no current. With current through it removed pass transistor 11 is called on to dissipate little or no power and is thereby protected from overload as a result of the crow-bar operation. This also protects the crow-bar since it too is called on to carry little or no sustained current which might otherwise cause it also to be overloaded and eventually damaged. Another result is that a lower dissipation silicon controlled rectifier can be used safely as the main crow-bar 20–21–22.

While only the preferred embodiment of the invention has been shown and described, modifications are possible within the spirit and scope of the appended claims.

I claim:

1. In a voltage/current regulated power supply comprising a source of unregulated voltage; at least one series pass transistor; at least one driver transistor for driving said series pass transistor; a current control amplifier; a voltage control amplifier; an OR gate for coupling said amplifiers to said driver transistor; first crow-bar means for crow-barring the output of the power supply; and crow-bar driving means; the improvement which includes;

second crow-bar means for activating said crow-bar driving means and coupled to said OR gate for disabling said driver transistor responsive to crow-barring of the power supply.

2. A voltage/current regulated power supply as set forth in claim 1;

wherein said second crow-bar coupling to said OR gate is a diode.

3. A voltage/current regulated power supply as set forth in claim 1;

wherein said crow-bar driving means includes in cascade;

a crow-bar comparison amplifier for comparing the output voltage of said power supply with a predetermined reference voltage and driving a pilot silicon controlled rectifier which in turn drives a crow-bar driver transistor for driving said crow-bar into conduction.

4. A voltage/current regulated power supply as set forth in claim 3;

wherein said crow-bar is a silicon controlled rectifier.

5. A voltage/current regulated power supply as set forth in claim 1, and including;

a comparison amplifier for comparing the output of the power supply with a reference voltage and coupled to said second crow-bar for firing said second crow-bar in response to an over-voltage of the power supply.

6. A voltage/current regulated power supply as set forth in claim 1, and wherein;

said first and second crow-bar means are silicon controlled rectifiers.

* * * * *